United States Patent [19]
Dorosz

[11] Patent Number: 4,478,299
[45] Date of Patent: Oct. 23, 1984

[54] ROCK BIT CONSTRUCTION

[75] Inventor: Dennis D. E. Dorosz, Victoria, Canada

[73] Assignee: Trend Rock Bit Alberta, Ltd., Victoria, Canada

[21] Appl. No.: 362,282

[22] Filed: Mar. 26, 1982

[51] Int. Cl.³ ..... E21B 10/10; E21B 10/22
[52] U.S. Cl. ..... 175/369; 175/371; 76/108 A; 384/95; 384/96
[58] Field of Search ..... 175/339, 337, 367–372, 175/340, 375, 359, 364; 76/108 A; 384/91–96

[56] References Cited

U.S. PATENT DOCUMENTS

| | | | |
|---|---|---|---|
| 1,873,245 | 8/1932 | Abegg | 175/369 |
| 2,321,484 | 6/1943 | Harrington et al. | 175/359 |
| 3,007,750 | 11/1961 | Cunningham | 175/227 |
| 3,127,942 | 4/1964 | Neilson | 175/372 |
| 3,480,341 | 11/1969 | Hickernell | 175/371 |
| 3,656,764 | 4/1975 | Robinson | 384/94 |
| 3,913,988 | 10/1975 | Scales et al. | 175/227 |
| 3,923,108 | 12/1975 | Williams, Jr. | 175/371 |
| 4,157,122 | 6/1979 | Morris | 175/369 |
| 4,256,193 | 3/1981 | Kunkel et al. | 384/92 |
| 4,304,444 | 12/1981 | Persson | 175/371 |

FOREIGN PATENT DOCUMENTS

| | | | |
|---|---|---|---|
| 233571 | 12/1969 | U.S.S.R. | 175/371 |

*Primary Examiner*—William F. Pate, III
*Assistant Examiner*—Hoang C. Dang
*Attorney, Agent, or Firm*—Gunn, Lee & Jackson

[57] ABSTRACT

A rotary earth boring drill is provided having a body structure with a plurality of depending cutter supporting legs having integral spindles extending transversely therefrom. Rotary cutter cone elements are supported by split bushings, roller bearings or a combination of the same, on appropriate bearing surfaces defined by the integral spindles. The bushings and cutter cones define mating tapered surfaces having an interference fit that secures the bushings and cutter cone in nonrotatable assembly. Circular locking elements are provided in locking grooves that are defined cooperatively by the bushings and cutter cones. End portions of the bushings extend axially beyond a planar surface defining one extremity of the cutter cone and establishes rotatable sealing engagement with an opposed planar surface defined by the depending leg structure of the bit. This rotatable seal prevents drill cuttings, dust and other debris from entering the bearing support of the cutter cone. A circular resilient seal may also be supported by the cutter cone and may also have rotatable sealing engagement with the planar surface of the depending leg, thus providing additional sealing and protection of the bushings and bearings.

13 Claims, 14 Drawing Figures

FIG. 5
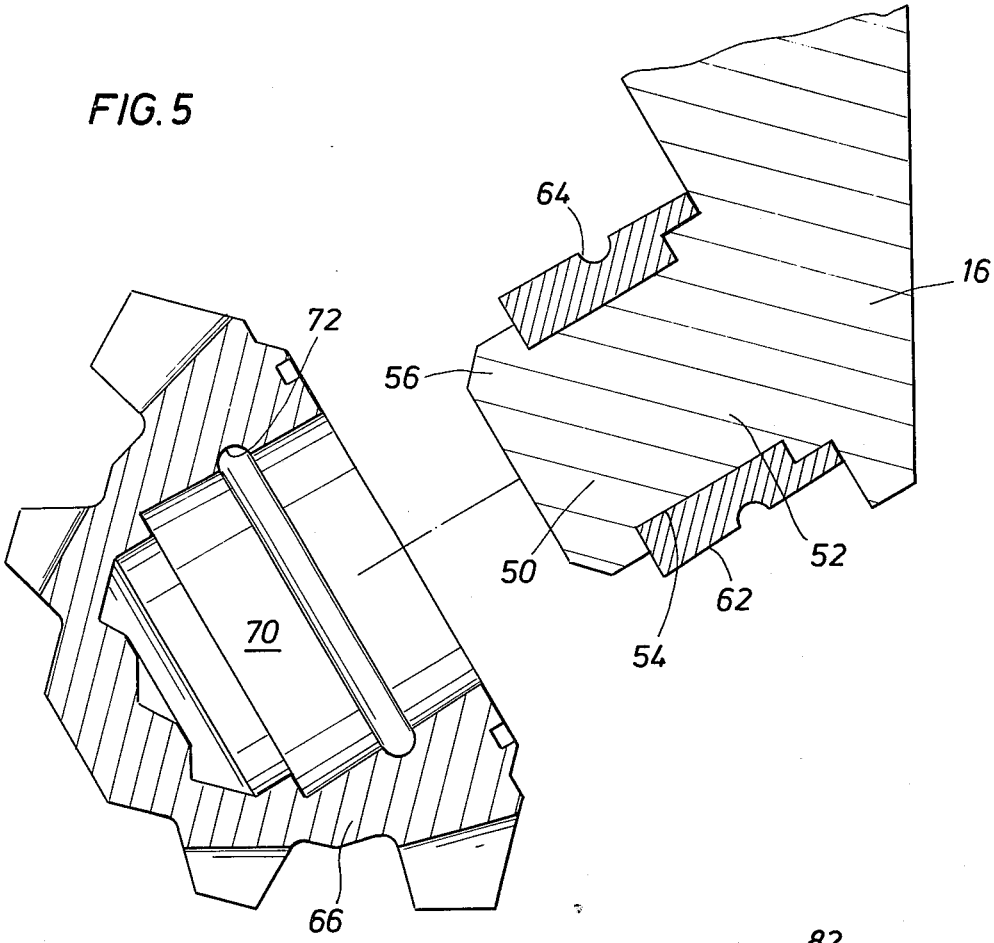
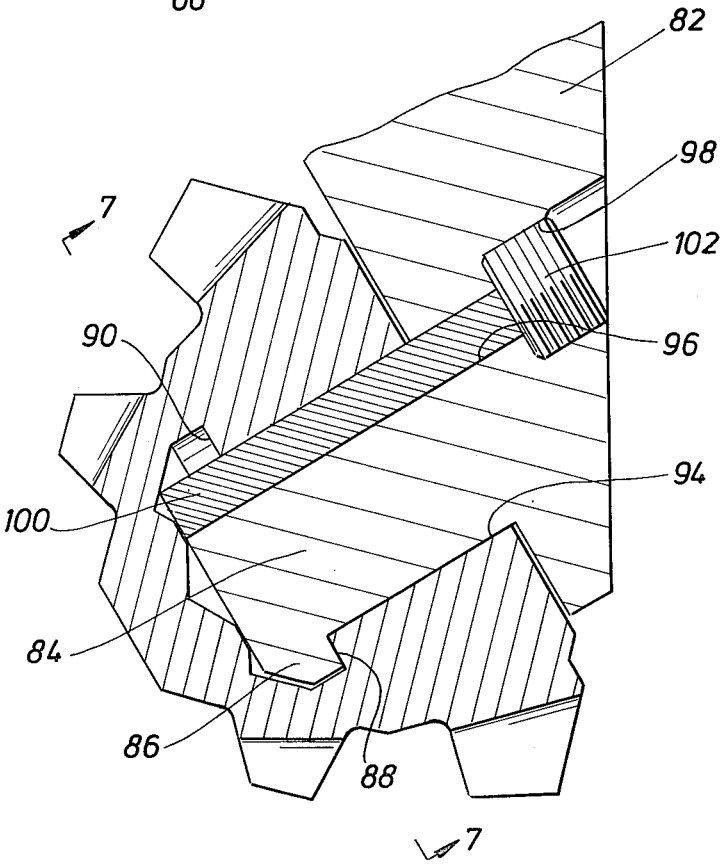
FIG. 6

FIG. 8
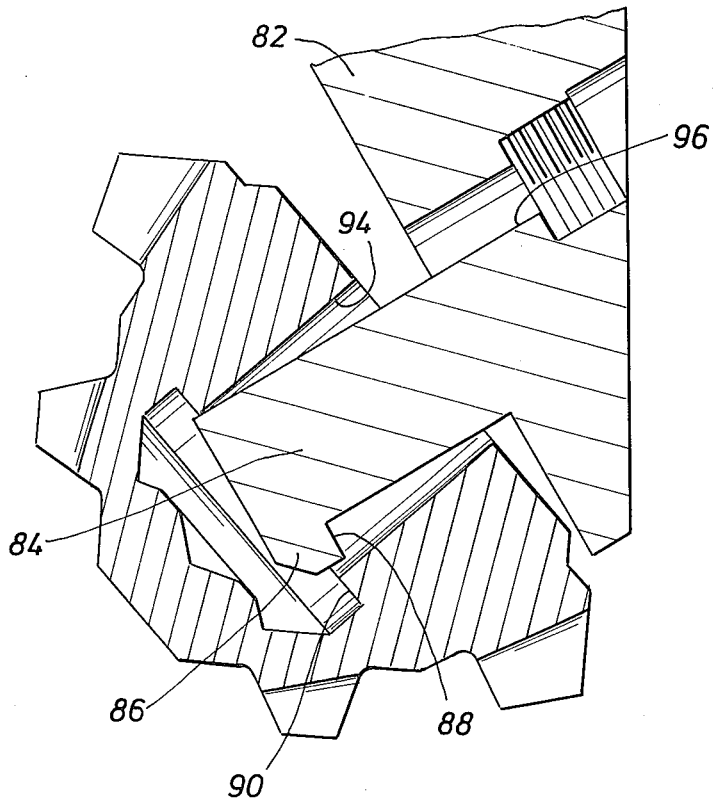
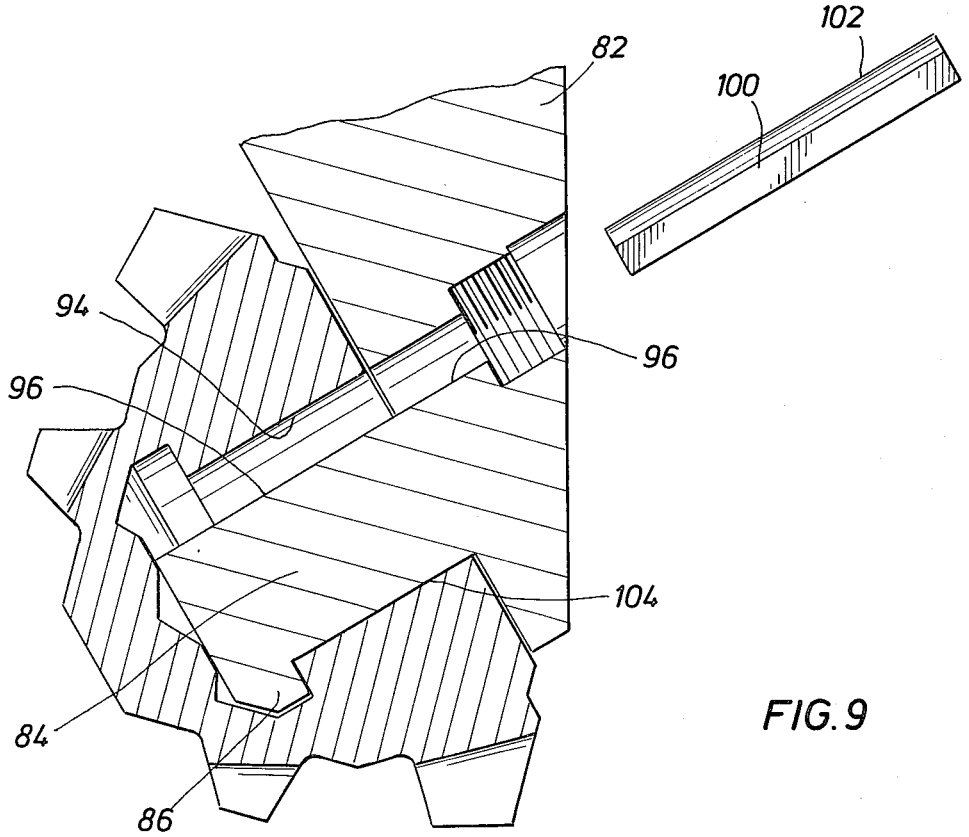
FIG. 9

FIG. 13
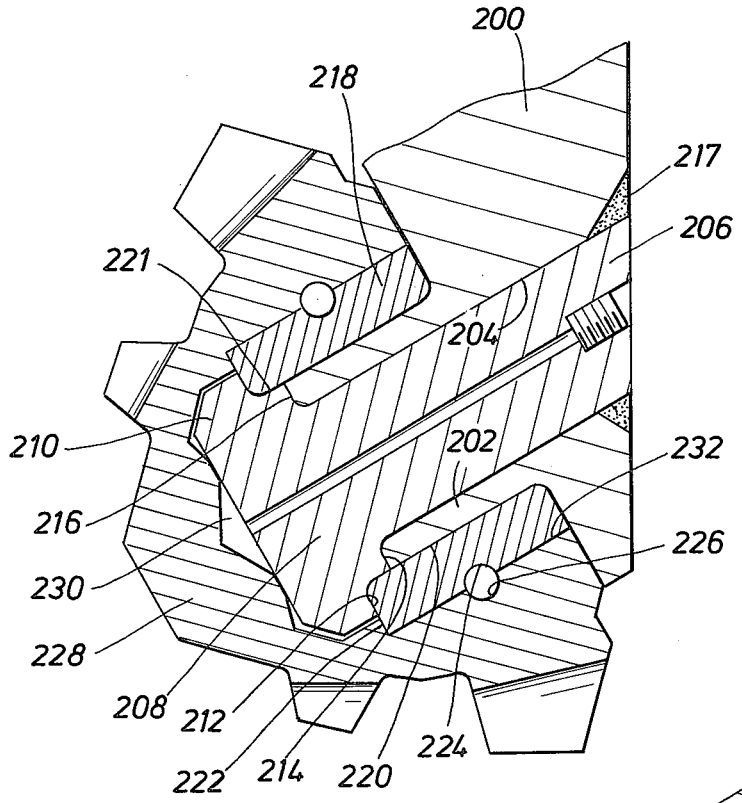
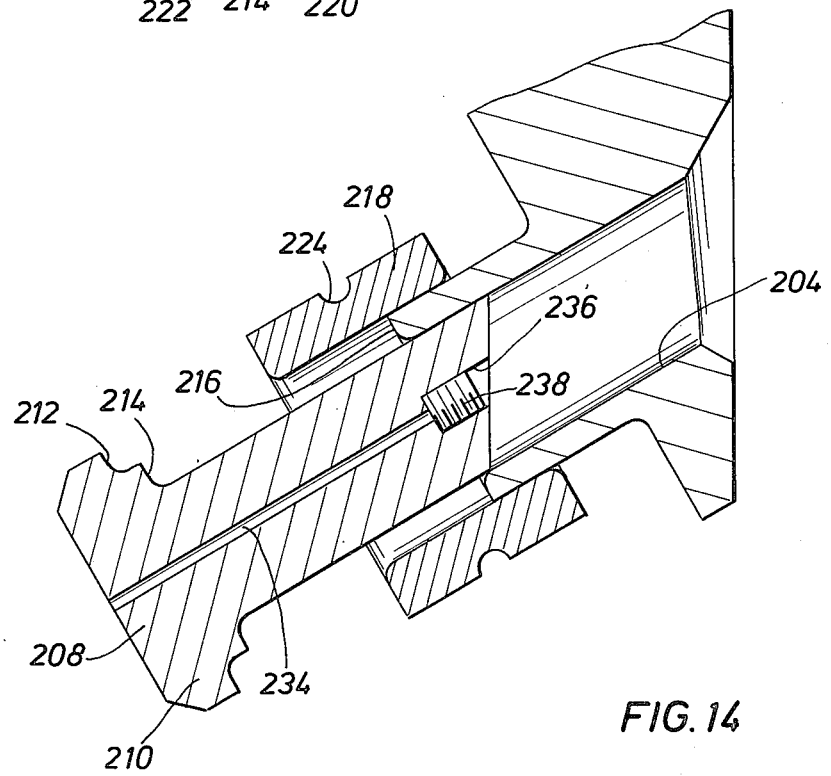
FIG. 14

ROCK BIT CONSTRUCTION

FIELD OF THE INVENTION

This invention relates generally to earth boring apparatus and more particularly to earth boring drills having rotary cutters for the purpose of accomplishing boring operations in relatively hard, consolidated earth formations. This invention also relates to a method of assembling earth boring drills constructed in accordance with the invention.

BACKGROUND OF THE INVENTION

In the drilling of deep wells in earth formations many different types of earth formations are encountered and boring or drilling operations in each of these types of formations require differing boring equipment. For example, in loose or unconsolidated earth formations such as gravel strata, it is desirable to utilize integral drill bits having a plurality of blades for cutting away the formation. Where consolidated, very hard earth strata is encountered, for example, in deep earth formations, it is typically desirable to employ drill bits having a plurality of rotary toothed cutters. The teeth of the rotary cutters are cooperatively associated so that the earth formation is cut away as the drill bit is rotated at the extremity of the drill pipe extending from the drilling rig to the formation being drilled. The typical rotary cutter type drill bit or "rock bit" includes a body portion from which depend three legs. Spindles or cutter supports extend inwardly toward the center line of the drill bit from each of these legs. Rotary cone type cutter elements having cutter teeth formed thereon are typically rotatably secured to each of the supports or spindles and are oriented in such manner that the cutter teeth thereon engage and cut away the earth formation as the bit structure is rotated by the drill pipe.

One of the paramount disadvantages of drill bits having rotary cutters is the inability of the cutter bearings to withstand the severe wear characteristics to which the drill bit is typically subjected. As drilling operations occur, rock bits are subjected to severe impacting and vibration as well as other wear inducing factors that are highly detrimental to the service life of the rotary cutter bearings and other components of such drill bits. At times, much of the weight of the drill pipe to which the rotary drill is connected may be caused to act upon the cutter, subjecting the cutters and their bearings to tremendous mechanical loads. It is therefore desirable that rotary drill devices be provided with incorporate bearings having the capability of withstanding extremely high forces, excessive vibration as well as high temperature operation.

Typically, the drill bodies of rotary cutter devices take the form of integral cast or forged structures that are very expensive to manufacture because of the complex configuration thereof. It is also desirable to provide a rotary drill bit construction having a body structure of exceptional strength and durability and yet being of relatively low cost. Drill bit cost is also adversely affected by the typical requirement for expensive materials for most of the structural components of such bits. For example, an expensive bearing quality material may be required for the drill cutters or the entire body structure of the bit if any part thereof is to define a wear resistant bearing surface.

It is therefore a primary feature of the present invention to provide a novel rotary cutter type drill bit construction that allows optimum utilization of materials for the various components thereof to insure optimum drilling capability and exceptional service life.

It is also a feature of the present invention to provide a novel rotary cutter type earth boring drill construction wherein a unique cutter supporting bearing and spindle assembly may be connected to structural components of the drill body by welding.

Among the several features of the present invention is contemplated the provision of a novel rotary earth boring drill construction incorporating bearing and spindle assemblies that, through optimum use of material, are capable of withstanding extremely severe operational loads.

It is an even further feature of the present invention to provide a novel rotary earth boring bit construction whereby the body structure of the bit may be formed by assembling a plurality of low cost body sections, thereby promoting the low cost aspects of the drill construction.

It is also an important feature of the present invention to provide a novel rotary earth boring bit construction whereby rotary cutter elements are assembled to respective spindle and bearing assemblies utilizing controlled changes in dimension by heating and cooling various ones for the drill bit components.

It is also a feature of the present invention to provide a novel rotary earth boring drill construction whereby mechanical locking means may be provided to insure positive locking of rotary cutter elements to the spindle bearing and thereby insure against separation of the cutter elements by vibration and other operationally induced forces.

It is a feature of the present invention to provide a method of manufacturing a rotary cutter type drill bit wherein cutter, bearing and spindle assemblies may be developed prior to attachment thereof to the drill body.

It is an even further feature of the present invention to provide a method of manufacturing a rotary cutter type drill bit wherein cutter, bearing and spindle assemblies may be assembled to body sections prior to connection of the body sections to form an integral body.

Other and further objects, advantages and features of the invention will become obvious to one skilled in the art upon an understanding of the illustrative embodiments about to be described and various advantages, not referred to herein, will occur to one skilled in the art upon employment of the invention in practice.

THE PRIOR ART

Rotary cutter type roller drills have been commercially available for an extended period of time as indicated by Godbold in U.S. Pat. No. 1,325,086. In some cases, the structure of the drill bit body has also been employed to accomplish bearing capability as taught by U.S. Pat. Nos. 2,620,686 of Peter and 3,361,494 of Galle. Various types of bearings have also been employed to support roller cutters such as the complex structures illustrated in U.S. Pat. Nos. 1,839,589, 2,004,012 and 2,126,041 all of Reed. Reed U.S. Pat. Nos. 1,839,589 and 2,004,012 and 1,957,532 of Flynn each disclose earth boaring drill constructions employing spindle structures that are secured to the body structure of the bit by mechanical means such as welding, bolting or the like. More recently, U.S. Pat. No. 4,157,122 discloses retention of roller cutters by means of shrink fit bushings or split bushings.

SUMMARY OF THE INVENTION

Rotary earth boring drill bit structures are provided in accordance with the present invention having rotary cutter elements that are uniquely connectable to the body structure of the bit and which function efficiently to withstand the detrimental effects of excessive loads and vibration during drilling operations. Depending leg portions of the drill body are formed to define integral bearing spindles which project at the proper angle from the legs to permit interrelated cutter activity. Typically, the rock bits will incorporate three depending legs and three interrelated rotary cutter elements having cutter teeth that are cooperatively arranged to achieve efficient boring as the rock bit is rotated in relation to the formation being drilled. The body structure of the bit may be formed by a fabrication procedure wherein three interfitting body sections are connected by welding to form an integral body structure. Each of the body sections may be of forged construction thereby permitting simplified manufacture of a bit body having exceptional strength and durability from the standpoint of metallurgy.

In each case, the rotary cutter elements will be of generally cone-like configuration having a plurality of external teeth formed thereon for cutting engagement with the earth formation to be drilled. Each of the cutter elements is also formed to define an internal cavity of particular size and configuration for receiving the spindle portion of the bit structure and a suitable bearing or bushing by which the cutter element is rotatably mounted in assembly with the spindle. In one form of the invention, the spindle, which is integral with the depending leg, defines a reduced diameter bushing receiving portion and a cooperative head structure that insures proper retention of the bushing in properly rotatable relation to maintain the rotary cone in proper relation with the depending leg of the bit. A split bushing is received within the bushing retaining portion of the spindle and is secured relative thereto by means of a retainer ring located within cooperative mating grooves formed in the outer periphery of the bushing and the inner periphery of the rotary cutter cone. The inner extremity of the split bushing extends beyond the axial extremity of the cutter cone and establishes rotatable sealing engagement with an opposed surface of the depending leg, thus preventing dust, sand, drill cuttings and other debris from entering and interfering with proper function of the bearings and bushings. An outer resilient seal may also be retained by the cutter cone for additional sealing engagement with the leg structure of the bit.

In another form of the invention, the depending leg structures of the drill bit define an integral spindle structure having a partial cutter retainer head formed thereon. The depending leg of the bit and the spindle are further formed to define a cooperative keyway which receives a wedge or key member. The wedge or key member functions to secure a rotary cutter cone in assembly with the spindle and permits the head structure of the spindle to secure the rotatable cutter cone against inadvertent disassembly from the spindle.

In another form of the invention, the depending leg structure of the bit is formed to define an integral spindle. The spindle and leg portion are further formed to define a bearing insertion passage. The rotatable cutter cone and the spindle are cooperatively shaped to define a bearing receptacle receiving a plurality of roller bearings therein. A bearing roller retaining element is placed within the roller insertion passage thereby closing the roller insertion passage and insuring that the bearing rollers remain within the bearing receptacle. The bearing rollers, in addition to providing rotatable support for the cutter cone on the spindle, also function to retain the cutter cone in assembly with the spindle.

In an even further form of the invention, roller bearings, which are inserted into a cooperative bearing receptacle through a bearing insertion passage, also function cooperatively with a split bushing arrangement to provide additional bearing capability and to secure the rotary cutter cone in assembly with an integral spindle portion of the bit structure.

In an even further form of this invention, a rock bit structure is formed by providing depending leg structures, each of which form partial integral spindle portions. A spindle element, forming the outer portion of the spindle, is fitted within a passage defined by the partial spindle portions of the bit. The outer spindle portion defines a head structure and is assembled to the depending leg structure of the bit by means of welding. A split bushing arrangement is also utilized to secure the rotary cutter cone in assembly with the spindle structure of the bit.

A simple and low cost drill body structure may be developed in accordance with the present invention by providing a plurality of body segments that may be assembled in any suitable manner. Each of these body segments may be composed of low cost forgings or castings of a material having sufficient strength for adequately resisting the forces to which the body structure will be subjected during drilling operations and yet being of relatively low material cost. The simple structure of each of the body segments enables the body segments to be developed by forging or casting at relatively low cost. Additionally, each of the body segments may be of generally identical configuration, thereby simplifying the pattern or mold costs that are required for production of the body structure. For example, the body structure may be composed of three segments that may be placed in intimate assembly. The segments may be joined by welding to form an integral drill body structure having three depending, cutter supporting legs.

BRIEF DESCRIPTION OF THE DRAWINGS

In order that the manner in which the above recited advantages and features of the invention are attained as well as others which will become apparent can be understood in detail, more particular description of the invention, briefly summarized above, may be had by reference to the specific embodiments thereof, that are illustrated in the appended drawings, which drawings form a part of this specification. It is to be understood, however, that the appended drawings illustrate only typical embodiments of this invention and are, therefore, not to be considered limiting of its scope, for the invention may admit to other equally effective embodiments.

IN THE DRAWINGS

Figure 1:
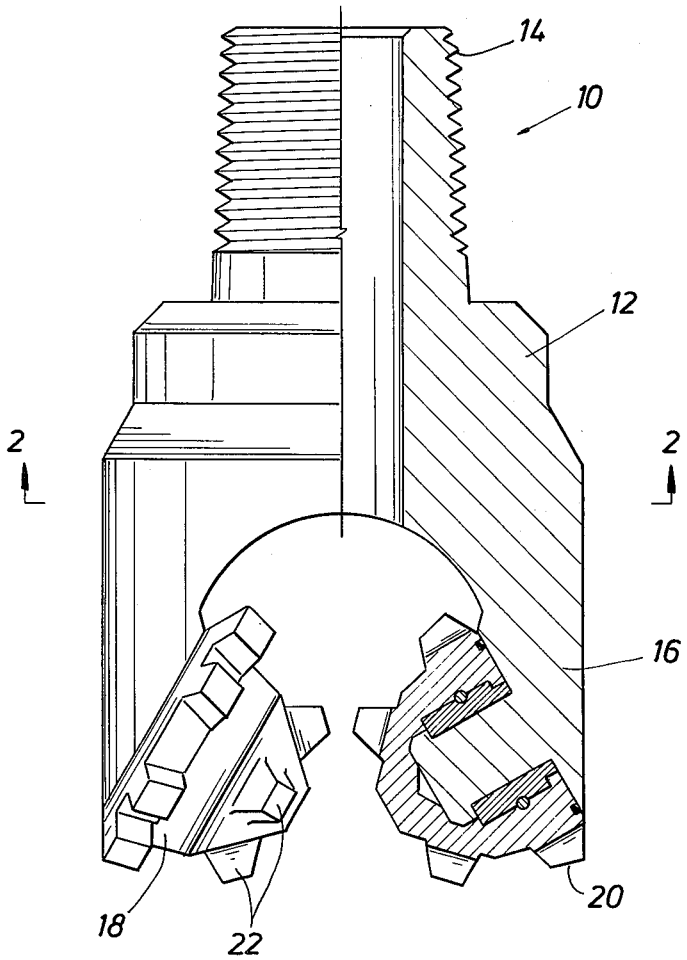

FIG. 1 is a pictorial representation of a rotary rock bit mechanism constructed in accordance with the present invention and having three rotatable cutter cones in assembly therewith.

Figure 2:
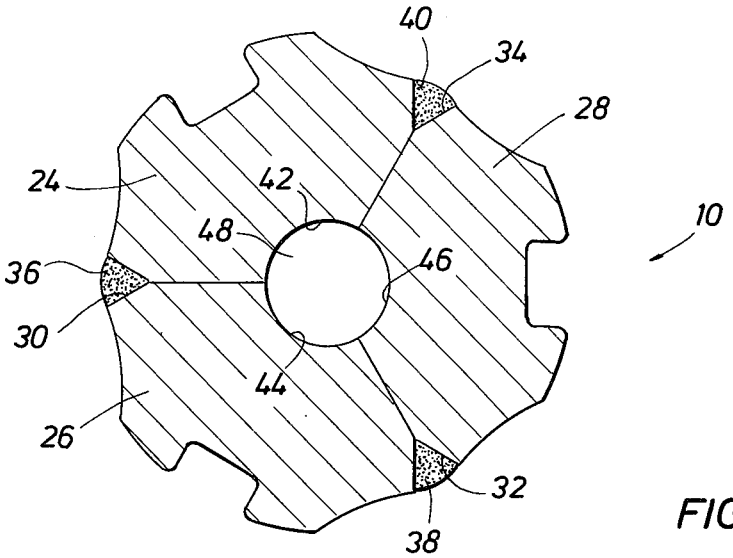

FIG. 2 is a transverse, sectional view taken along line 2—2 of FIG. 1 and illustrating manufacture of the drill bit body by means of welded fabrication.

Figure 3:
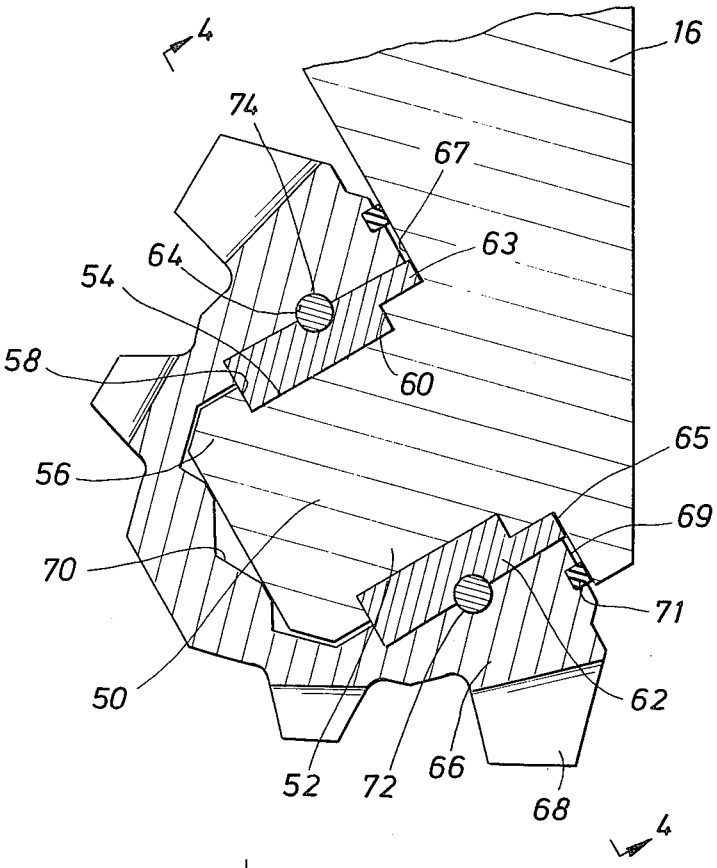

FIG. 3 is an enlarged, fragmentary, sectional view of the rock bit mechanism of FIG. 1 illustrating one of the depending cutter supporting legs and showing a cutter cone mounted in rotatable assembly therewith by means of a split bushing arrangement.

Figure 4:
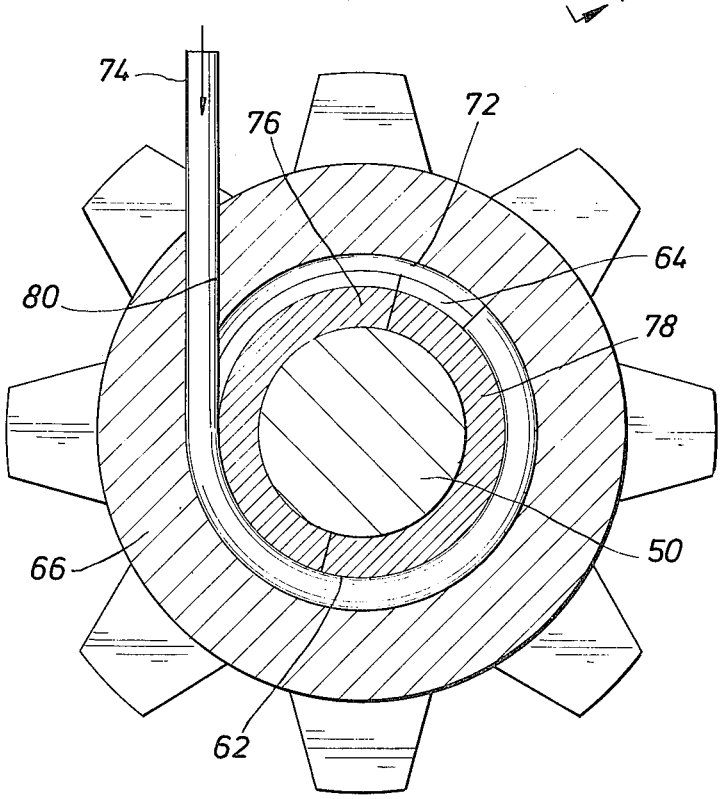

FIG. 4 is a sectional view taken along line 4—4 of FIG. 3 showing the split bushing arrangement and showing insertion of an elongated locking member within a locking groove to secure the rotary cutter in assembly with the spindle.

FIG. 5 is an expanded, fragmentary, cross-sectional view of the drill bit structure of FIGS. 1 and 3, illustrating the relationship of the spindle, split bushing and rotatable cutter cone.

FIG. 6 is a fragmentary, sectional view of a rock bit structure representing a modified embodiment of this invention and showing a rotatable cutter cone being retained in assembly with an integral spindle structure by means of a retainer key positioned within a keyway cooperatively defined by the drill bit leg, spindle and rotatable cutter cone.

Figure 7:
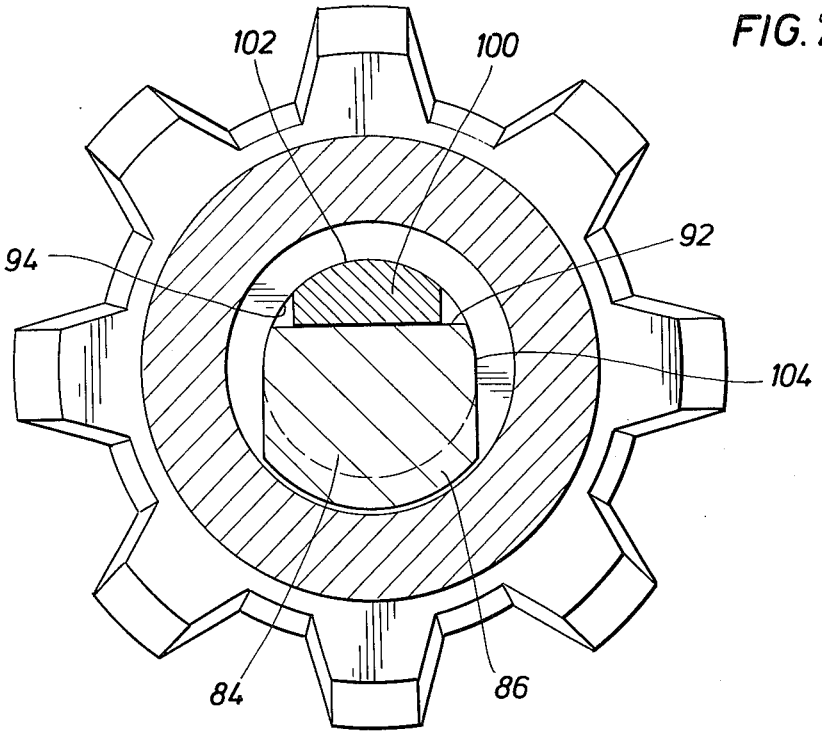

FIG. 7 is a sectional view taken along line 7—7 of FIG. 6.

FIG. 8 is a fragmentary, sectional view of the drill bit structure of FIG. 6, illustrating assembly of the rotatable cutter cone to the partial integral spindle portion of the drill bit structure.

FIG. 9 is a fragmentary, sectional view of the bit structure of FIG. 6, illustrating insertion of the spindle key into its keyway to provide for locking of the rotatable cutter in assembly with the spindle.

Figure 10:
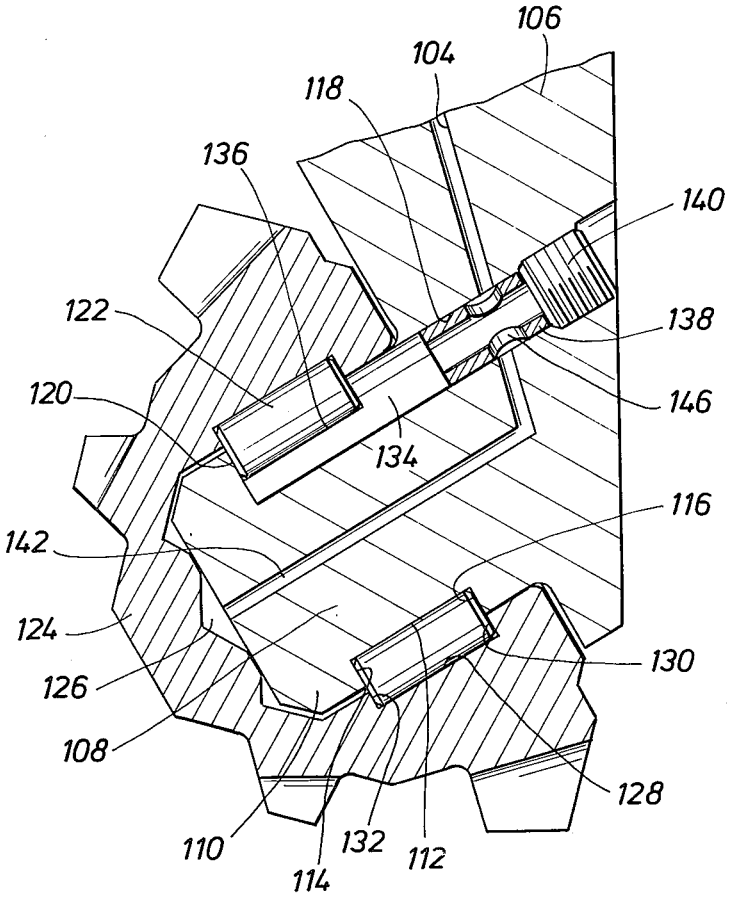

FIG. 10 is a fragmentary, sectional view of one of the depending legs of a rock bit constructed in accordance with this invention and representing a modified embodiment incorporating a rotatable cutter cone that is retained in assembly with an integral spindle by means of roller bearings.

Figure 11:
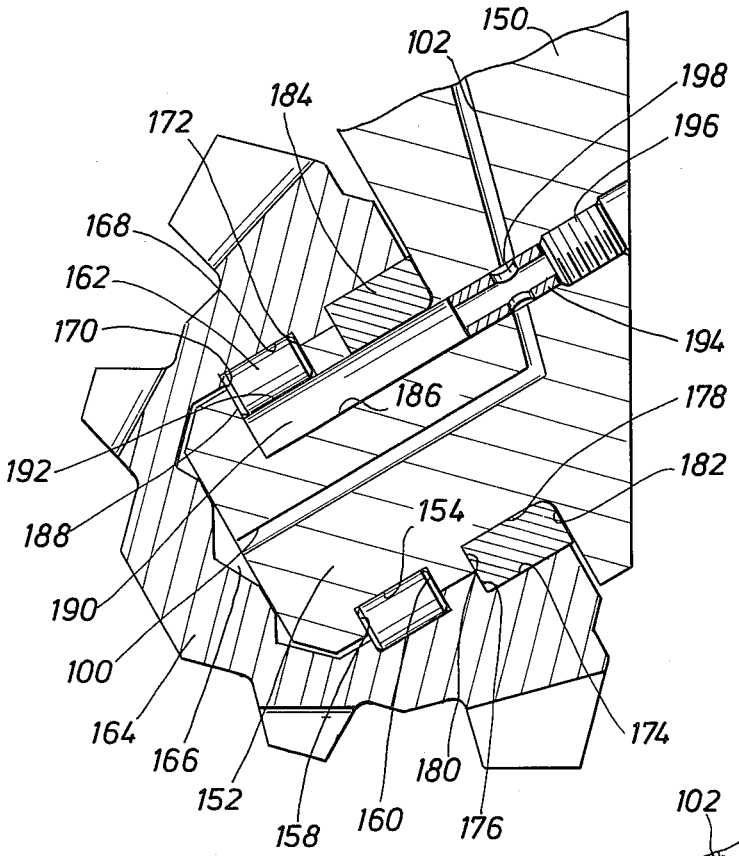

FIG. 11 is a fragmentary, sectional view of a depending leg portion of a rock bit structure illustrating cooperative roller bearings and split bushings which function to retain a rotary cutter element in assembly with an integral spindle portion of the bit structure.

Figure 12:
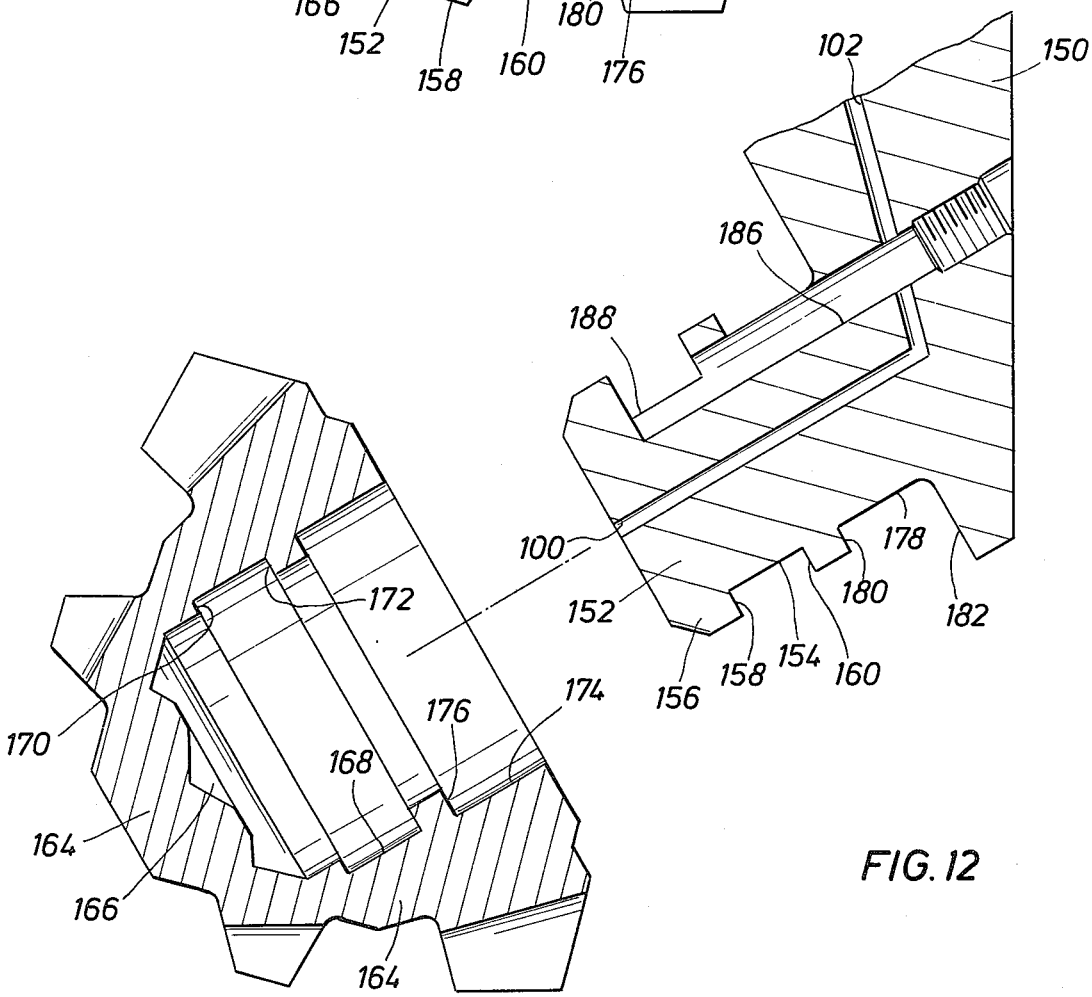

FIG. 12 is an exploded, sectional view of the bearing structure of FIG. 11.

FIG. 13 is a fragmentary, sectional view of a portion of a rock bit structure representing an even further modified embodiment of the present invention embodying a partially fabricated spindle arrangement for securing a rotary cutter element in assembly with the bit structure.

FIG. 14 is an exploded view of the rock bit structure of FIG. 13, illustrating assembly of the spindle and bearing retainer portions of the bit structure.

DETAILED DESCRIPTION OF PREFERRED EMBODIMENTS

With reference now to the drawings and first to FIG. 1, a rotary cutter-type drill bit shown generally at 10, in quarter-section, is of the type typically referred to in the industry as a "rock bit". The rotary bit structure 10 generally comprises a body structure 12 having a threaded upper extremity 14 for attachment of the drill bit to the lower section of a string of drill pipe, not shown. The body structure 12 also includes a plurality of depending cutter support legs 16, each supporting a rotary cutter element such as shown at 18 and 20. Each of the cutter elements are provided with a plurality of teeth 22 formed thereon to provide for optimum engagement between the teeth of each of the cutter elements and the formation being drilled. Each of the cutter elements of the bit structure will be of slightly different configuration, whereby the teeth of each cutter will cooperate with the teeth of the other cutters to provide for efficient cutter engagement with the formation as the rock bit is rotated relative thereto.

It is considered desirable to provide a drill body structure that is of low cost nature without any sacrifice from the standpoint of strength and durability. This feature may be conveniently accomplished in the manner illustrated particularly in FIG. 2. A plurality of body segments are provided such as shown at 24, 26 and 28 and are of substantially identical configuration. The body sections may be formed by forging, casting or in any other suitable manner. Since the casting or forging design of each of the body segments is of simple configuration, the casting or forging costs will be quite low and yet the body structure that is developed will be of substantial strength and durability when the body sections are assembled. As shown, each of the body sections comprise one-third of the body structure of the bit. The outer portions of the body segments are configured such that cooperative assembly of the body segments defines a plurality of welding grooves 30, 32 and 34 within which weld metal 36, 38 and 40 is deposited to secure the body segments in integral assembly. Each of the body segments also defines a partially cylindrical, internal surface such as shown at 42, 44 and 46 which cooperate to define a generally cylindrical passage 48 when the segments are positioned in assembly. The passage 48 functions as a flow passage for drilling fluid to provide the rotary cutter elements with cooling and flushing of drill cuttings in order to provide for efficient drilling. As shown, each of the body segments are formed to define segment abutment surfaces that are oriented at an angular relationship of 120°. When the body segments are assembled, the abutment surfaces will be in engagement, thus orienting the rotary cutter elements of each of the body sections in proper relationship for optimum cutting capability.

Referring now to FIG. 3, the fragmentary sectional view illustrates the lower portion of one of the depending legs 16 of the rock bit 10 of FIG. 1, illustrating the lower structure thereof in detail. The depending leg 16 defines a transversely extending integral cutter spindle 50 having a reduced diameter intermediate bushing support portion 52 which defines a cylindrical bearing surface 54. The reduced diameter bearing support portion of the spindle forms an integral bushing retainer head 56 at the free extremity of the spindle and also defines a circular bushing restraining shoulder 58. A second bushing restraining shoulder 60 is formed at the opposite end of the bearing retaining portion of the spindle and cooperates with shoulder 60 to form a bushing groove. A split bushing 62, composed of two or more bushing segments, is received within the bushing retaining groove of the spindle. The bushing is of such axial length as to have slight clearance with the thrust surfaces 56 and 60. For example, with the bushing in engagement with one of the thrust shoulders, a clearance in the order of 0.010 inches is established. The split bushing 62 further defines an annular projecting rim portion 63 which surrounds the thrust shoulder 60 and defines an end surface 65 which engages a planar surface 67 of the leg structure 16. The axial length of the annular rim 63 is such that the end surface 65 thereof extends past the planar end surface 69 of the cutter element and bears directly on the planar surface 67. This feature provides the cutter with standoff from surface 67 and allows the bushing to rotate directly on surface 67 resulting in the development of a self-sealing effect. The end portion of the annular rim 63, in time, will wear a slight circular groove in the surface 67 of the leg, thus further enhancing the development of a seal which prevents drill cuttings, dust and other debris from entering the bearing. The split bushing 62 defines a circular groove 64 in the outer periphery thereof which cooperates with the other bushing segments to define a groove that completely encircles the outer periphery of the bushing.

The bushing 62 and cutter cone 66 are formed to define a cooperative interference fit when in assembled relation. The spindle receptacle 70, of the cutter cone, defines an internal tapered surface 73 which is of larger diameter within the cutter cone than at the opening of the spindle receptacle. Likewise, the bushing 62 defines an outer tapered surface 75 of mating tapered configuration with the internal cone surface 73. The dimension of these tapered mating surfaces is such as to define an interference fit at ambient temperature. These receptive dimensions are such that by cooling the spindle and bushing to cause shrinkage and by heating the cutter cone to cause heat induced expansion, the bushing can be inserted into the spindle receptacle thus positioning the tapered surfaces of the cutter cone and bushing in assembled relation. When the cutter cone and bushing reach ambient temperature, the dimensions of tapered surfaces 73 and 75 will have changed such that seizing will have occurred. The taper of surfaces 73 and 75 is evidenced clearly by means of angle representing arrows in the exploded sectional view of FIG. 5.

The bushing and bearing surface may be afforded additional contamination by drill cuttings, dust and other debris by means of an annular elastomeric seal 71 which is supported by the cutter and positioned for rotatable sealing engagement with planar surface 67 of the depending leg 16.

A cutter cone 66 is provided having a plurality of cutter teeth 68 extending therefrom for cutting engagement with the formation being drilled. The cutter cone 66 is formed internally to define a spindle receptacle 70 of sufficient size and dimension to receive the spindle 50 and the bushing 62 therein. The cutter cone 66 is formed internally thereof to define a circular groove 72 of mating semi-circular cross-sectional configuration with the outer peripheral circular groove of the segmented bearing 62. When the cutter cone 66 is properly received about the spindle and bearing, the mating grooves of the cutter cone and bushing will become registered and define a circular groove of circular cross-sectional configuration. Within this circular groove is received a retainer ring 74 which functions to lock the cutter cone in assembly with the bushing 62. As shown in section in FIG. 4, the bushing 62 comprises two bushing segments 76 and 78 each forming a 180° arc and interfitting together to define a complete 360° bushing. These bushing segments cooperate to define the circular retainer locking groove 64. As further shown in FIG. 4, the cutter cone 66 is formed to define a tangential insertion passage 80 through which the locking element 74 is inserted into the groove cooperatively defined by the bushing segments and the internal groove segment of the cutter cone. After the locking element 74 has been inserted into the cooperative groove 64 and 72, a locked relationship is established between the bushing 62 and the cutter cone. The cutter cone and bushing will, therefore, rotate with respect to the spindle 50 but is held in assembly with the spindle by means of the interference fit between the cutter cone and bushing segments and by the locking effect of the locking retainer element 74. The locking retainer element forms a retainer ring after being fully inserted into its retainer groove.

It may be desirable to provide a spindle arrangement and rotatable drill cutter therefor wherein the cutter element is rotatable directly on a bearing surface defined by the spindle. Accordingly, a drill bit construction of this nature may conveniently take the form illustrated in FIG. 6 wherein a depending leg structure 82 is shown having a spindle structure 84 formed integrally therewith. The spindle 84 defines a retainer head portion 86 as is evidenced in FIG. 7. The retainer head portion 86 of the spindle 84 extends only partially beyond the free extremity of the spindle structure 84. The retainer head 86 defines a transversely projecting retainer shoulder 88 which is positioned for retaining engagement with a circular shoulder 90 defined internally of the cutter cone as shown in FIG. 6. The upper portion of the spindle is cut away defining an elongated planar surface 92 which cooperates with an inner cylindrical surface 94 of the cutter cone to define an elongated keyway. Likewise, the depending leg structure 82, of the drill bit, is formed to define an internal keyway 96 having the outer portion thereof internally threaded as shown at 98. An elongated key element 100 is receivable within the keyway in the manner shown in FIGS. 6 and 7 to thereby lock the rotary cutter element against transverse movement relative to the spindle 84. A locking screw 102 is receivable within the threaded portion 98 and functions to lock the key member 100 within the keyway defined cooperatively by the cutter element, the spindle and the depending leg of the drill bit structure. As shown in FIG. 8, with the key element 100 removed from the keyway, the cutter cone may be inserted into assembled relation with the spindle in angulated manner as shown in FIG. 8. The cutter cone is then moved to the position shown in FIG. 9 such that the shoulders 88 and 90 of the spindle and cutter cone are brought into cutter retaining engagement. After this has been accomplished, the elongated key member 100 is inserted through the key opening 96 of the depending leg 82 and is also extended through the registering keyway defined cooperatively by the planar surface 96 of the spindle and the cylindrical surface 94 of the cutter cone. The key element 100 is then locked in assembly by means of the retaining screw 102. The elongated key member 100 prevents the cutter element from moving to the position shown in FIG. 8, which is the only position by which the cutter element may become disassembled from the integral spindle 84. The key member 100 defines a partially cylindrical outer surface 102 having the same radius of curvature as that of the cylindrical bearing surface 104 defined by the spindle 84. When the key member has been inserted within the key recess in the manner shown in FIG. 7, the partially cylindrical surface 102 of the key member cooperates with the partially cylindrical surface 104 of the spindle to define a completely cylindrical bearing surface for bearing engagement with the cylindrical internal bearing surface 94 of the rotary cutter cone. Further, the key member maintains the relative positions of the cutter cone and spindle such as shown in FIG. 6, thereby permitting retention of the cutter cone by means of the shoulder 88 of the head portion 86 thereof. The cutter cone, therefore, rotates directly on the spindle and is prevented from separation from the spindle by means of the spindle head 86.

It may also be desirable to provide a rock bit construction, according to the present invention, and having rotary support of the cutter cone being defined by roller bearings. In order to accomplish this feature, a drill bit construction may be provided in accordance with the fragmentary sectional view illustrated in FIG. 10. In this case, a bit construction is provided having depending legs, one of which is shown at 106 in FIG. 10. The depending leg 106 is formed to define an integral cutter supporting spindle 108 having a generally circular head portion 110. The spindle structure is also formed to define a reduced diameter bearing groove forming a generally cylindrical bearing surface 112 and transverse bearing thrust shoulders 114 and 116.

The depending leg structure 106, of the drill bit, is formed to define a bearing insertion passage 118 which extends along the upper outer peripheral portion of the spindle 108. At the outer portion of the bearing insertion passage 118, the upper portion of the spindle is cut away in such manner as to define a transverse bearing opening 120. The bit construction is provided with a plurality of roller bearings 122 which provide rotary support for a cutter cone 124. The cutter cone is of hollow construction defining a spindle receptacle 126 having an enlarged intermediate portion defining a cylindrical bearing surface 128. The cutter cone also defines a pair of circular thrust shoulders 130 and 132 which are spaced apart slightly greater than the length of the roller bearing members 122. The cooperative relationship of the cylindrical bearing surface 128 with the thrust shoulders 130 and 132 defines a circular bearing groove within the cutter 124 within which the bearing members 122 are located. The bearing surface 112, of the spindle, together with thrust shoulders 114 and 116, cooperate with bearing surface 128 and its respective thrust shoulders so as to define a circular bearing chamber receiving the roller bearings 122. The roller bearings are inserted within the bearing chamber by simply moving them lengthwise, in serial manner, through the bearing insertion passage 118. After reaching the outward limit of the bearing insertion passage, the rollers are then moved transversely through the bearing opening 120 into the bearing receptacle or groove defined cooperatively by the bearing surfaces 112 and 128. After a sufficient number of roller bearings have been inserted to fill the bearing chamber, a bearing retainer element 134 is inserted within the bearing insertion passage 118. The bearing retainer element is positioned such that a bearing surface 136, thereof, lies in coextensive relation with the bearing surface 112 of the spindle. If desired, the bearing retainer element may be press-fitted within the bearing insertion passage 118 to insure that its bearing surface 136 does not become misaligned with respect to the bearing surface 112. Also, if desired, the bearing retainer element may be provided with any suitable locator structure that cooperates with the spindle to maintain the bearing retainer in immovable relation within the bearing insertion passage. The bearing retainer element 134 may be secured, in its position, by means of a coolant spool 138 and a retainer screw 140. The retainer screw is threadedly received by an internally threaded outer portion of the bearing insertion passage 118.

In order to provide the bit structure of FIG. 10 with cooling or lubrication, the spindle 108 may be drilled to form a lubricant or coolant injection passage 142 which intersects with a passage 144 extending through the depending leg 106. The spool 138 is formed to define openings 146 that register with the injection passage 144 and thus permit introduction of lubricant or coolant through the passage 144 and through the spool to the injection passage 142. Lubricant such as grease or coolant, such as air or water is thus fed into the spindle receptacle 126 of the cutter cone and outwardly around the spindle to the roller bearings 122.

In the event it may be desirable to provide a drill bit construction having both rotary bearings and bushings to provide rotary support for a cutter cone, such construction may conveniently take the form illustrated in FIGS. 11 and 12. As shown in these Figs., a drill bit construction may be provided with a depending leg structure 150 having a spindle 152 formed integrally therewith. The spindle 152 forms a reduced diameter, cylindrical bearing groove 154 and an external, bearing retainer head portion 156. The bearing retainer groove 154 defines a cylindrical bearing surface having thrust shoulders 158 and 160 which retain roller bearing members 162 in captured rotatable relation therein. A rotary cutter cone 164 is provided which is of hollow configuration defining a spindle receptacle 166. The cutter cone 164 forms an internal circular bearing groove defined by a cylindrical bearing surface 168 and circular thrust shoulders 170 and 172. The cutter cone is also formed internally thereof to define an internal tapered bushing surface 174 having a circular thrust surface 176 at one axial extremity thereof. Likewise, the spindle structure 152 defines a cylindrical bearing surface 178 having thrust shoulders 180 and 182 at each of the axial extremities thereof. A circular split bushing 184 is received within the bearing groove defined cooperatively by the bearing surfaces 174 and 178. The bushing 184 may be composed of two or more bushing segments such as shown in FIG. 4. The taper of surface 174 is such as to develop a larger diameter at thrust shoulder 176 than at the opposite extremity thereof. The mating bushing surface 175 is also cooperatively tapered to define a heat induced interference fit between surfaces 174 and 175 in the manner discussed above in connection with FIGS. 3 and 5.

The depending cutter support leg 150, of the bit structure, and the integral spindle as drilled or otherwise formed to define an elongated bearing insertion passage 186 through which the roller bearing members 162 are inserted. A transverse bearing opening 188 is defined at one extremity of the passage 186 and permits transverse movement of the bearing elements 162 into the respective bearing receptacle defined cooperatively by the spindle and cutter cone. A bearing retainer element 190 is positioned within the passage 186 and presents an arcuate surface 192 thereof in registry with the cylindrical bearing surfaces 154 and 178 of the respective bearing and bushing grooves. The bearing retainer element 190 is retained in its position by means of a spool member 194 which is secured by means of a retainer screw 196. The spool member 194 defines lubricant or coolant openings 198 that register with passages 100 and 102 which are formed within the spindle and depending leg portions of the bit structure thus permitting the flow of coolant such as air, water, etc. or lubricant such as grease to the spindle receptacle for distribution to the bearings and bushings.

FIG. 12 is an exploded view illustrating the structure of the cutter cone and the depending leg structure 150 with its integral spindle 152. During assembly, the first assembly step comprises placement of the split bushing structure 184 in assembly within the bushing groove 178 of the spindle. After this has been accomplished, the spindle and bushing assembly is inserted within the spindle receptable 166 of the cutter cone. The roller bearings 162 are then inserted through the bearing insertion passage 186 and are moved transversely through the bearing opening 188 into the roller bearing groove defined by surfaces 168 and 192. After the roller bearings have been inserted, the bearing retainer element 190 is then inserted through the passage 186 and is positioned as shown in FIG. 11. The spool 194 is then inserted and is secured by means of the retainer screw 196.

The cutter cone and leg structure form opposed generally planar surfaces 185 and 187 respectively. The bushing extends beyond surface 185 and has rotatable sealing engagement with surface 187 to provide protection against contamination of the bushing and bearings by dust and other debris. Additionally, an elastomer peripheral seal 189 may be retained by the cutter and provide additional sealing capability through rotary sealing engagement with surface 187.

It may be desirable to provide a bit structure incorporating a spindle arrangement wherein the spindle secures a bushing in assembly with the bit structure. Accordingly, a drill bit, having these features, may conveniently take the form illustrated in FIGS. 13 and 14. In the assembly view of FIG. 13, the bit structure may incorporate a depending leg portion 200 having a spindle projection 202 extending transversely thereof. The spindle projection and the depending leg 200, of the bit structure, are formed to define a spindle passage 204 through which extends the connecting shank portion 206 of a spindle 208. The spindle 208 also defines an external enlarged head portion 210 which forms a circular bearing thrust shoulder 212 and a circular seating shoulder 214. The shank portion 206 of the spindle is inserted through the spindle passage 204 to such extent that the seating shoulder 214 thereof bears against a circular end surface 216 defined at the free extremity of the integral spindle portion 202 of the depending leg. With the spindle 208 so positioned, the spindle is welded to the depending leg by means of a circular weld as shown at 217. A spindle construction is, therefore, defined which includes an outer cylindrical bearing surface 220 which is formed by the outer periphery of the integral spindle portion 202 and a cylindrical surface 221 of the spindle 208. A circular bushing member 218 is provided which is of the split bushing type shown in FIG. 4 and which is received about the cylindrical bearing surface 220–221 of the spindle construction. The circular thrust shoulder 212, of the spindle, forms a stop shoulder for a circular end surface 222 of the bushing structure 218. The bushing is further formed to define an outer retainer groove 224 which cooperates with a retainer groove 226 formed within a cutter element 228 to define a locking groove within which may be received a locking element in the manner shown at 74–80 of FIG. 4. The cutter cone 228 defines an internal spindle receptacle 230 forming an internal cylindrical surface 232 which is disposed for engagement with the outer periphery of the split bushing 218.

The spindle element 208 is formed to define a lubricant passage 234, the outer extremity of which is internally threaded as shown at 236. The lubricant passage 236 is closed by means of a closure plug member 238 after lubrication of the rotary cone, spindle and bearing assembly. If desired, the lubricant plug may conveniently take the form of any suitable grease fitting, such as a conventional Zerk fitting, if desired, to enable convenient lubrication of the drill bit such as when the drill bit is temporarily removed from the wellbore during servicing activities.

In view of the foregoing, it is readily apparent that a drill bit or rock bit construction has been set forth which clearly accomplishes all of the various features set forth hereinabove, together with other features which are inherent in the construction of the drill bit itself. It is apparent that the present invention provides a rotary drill bit construction having a body structure of exceptional strength and durability and yet being of low cost as compared to completely cast or forged drill bit structures. The drill bit body segments, being low cost forged or cast metal structures, may be connected in assembly by simple and efficient low cost welding procedures to define an integral body structure of exceptional strength and durability. The invention also provides for optimum utilization of materials for the various components of the drill bit construction to insure optimum drilling capability and exceptional service life. The spindle structure, of the drill bit, may be formed integrally with the depending leg portions of the bit or, in the alternative, may take the form of a composite structure including an integral spindle projection and a spindle which is welded in assembly therewith. The rotary cutter devices, of the bit structure, may be assembled to depending leg portions of the body by means of simple and efficient assembly techniques incorporating split bearing assemblies with interference fitting relation with the cutter cone, incorporating roller bearings or a combination of the same. The present invention also promotes utilization of lubrication and cooling systems that allow the drill bit structure to be periodically lubricated to further enhance the service life thereof. The invention also promotes efficient sealing of the bushings and bearings by means of bearing sealing and resilient sealing, thus providing for extended service life of the resulting drill bit. It is apparent, therefore, that the present invention is one well adapted to attain all of the objects and features hereinabove set forth together with other advantages which will become obvious and inherent from the description of the apparatus itself. It will be understood that certain combinations and subcombinations are of utility and may be employed without reference to other features and subcombinations. As many possible embodiments may be made of this invention without departing from the spirit or scope thereof, it is to be understood that all matters herein set forth or shown in the accompanying drawings are to be interpreted as illustrative and not in any limiting sense.

What is claimed is:

1. A rotary earth boring drill bit, comprising:

(a) a body structure adapted for threaded connection to a string of drill stem, said body structure defining a plurality of depending cutter supporting legs;

(b) spindle means being formed integrally with each of said depending legs and extending transversely therefrom, said spindle means defining bearing retainer head means at the free extremity thereof, a reduced diameter cylindrical bearing surface means intermediate the extremity thereof and a circular thrust shoulder at the juncture of said spindle means with said cutter supporting leg;

(c) rotary cutter means defining external cutter teeth and forming an internal spindle and bushing receptacle and further forming internal locking groove means and a lock insertion opening in communication with said internal locking groove means, said rotary cutter means also defining a circular planar surface having a circular seal groove therein, said spindle and bushing receptacle being defined in part by a cylindrical internal surface in intersecting relation with said circular planar surface;

(d) segmented bushing means being positioned about said cylindrical bearing surface means and being received within said spindle and bushing receptacle such that the outer periphery of said segmented bushing means is in mating engagement with said cylindrical internal surface of said rotary cutter means, said segmented bushing means defining annular external locking groove means in registry with said internal locking groove means within said cutter means, one end of said segmented bushing means forming a projecting rim portion extending axially beyond said circular thrust shoulder and said circular planar surface and engaging the respective one of said cutter support legs and maintaining said circular planar surface in spaced relation with said cutter support leg, said segmented bushing means further forming a circular abutment portion having abutting engagement with said circular thrust shoulder;

(e) locking means being positioned about said segmented bushing means and securing said rotary cutter means in locked assembly with said segmented bushing means, such that said rotary cutter means and segmented bushing means are rotatably mounted on said spindle means; and (f) a circular seal element extending axially from said circular seal groove and establishing sealing engagement with the respective one of said cutter support legs, compression of said circular seal element being limited by said axially extending projecting rim portion of said segmented bushing means.

2. A rotary earth boring drill as recited in claim 1, wherein:

said body structure is defined by a plurality of body segments, said body segments being secured in assembly by welding.

3. A rotary earth boring drill bit as recited in claim 2, wherein:

said body segments cooperate to define flow passage means for conducting drilling fluid from said drill stem toward said rotary cutter means.

4. A rotary earth boring drill bit as recited in claim 3, wherein:

each of said body segments defines one of said depending legs.

5. A rotary earth boring drill bit as recited in claim 1, wherein:

(a) said bushing means defines an outer tapered surface of greater dimension at the outer extremity than at the inner extremity thereof; and (b) said cutter means defines a tapered internal surface forming a part of said internal spindle receptacle and being of larger dimension at the inner extremity than at the outer extremity thereof, said outer extremity of said bushing being received at the inner extremity of said internal spindle receptacle, said bushing means and said cutter means having an interference fit securing the same in assembly.

6. A rotary earth boring drill bit as recited in claim 1, wherein:

(a) said lock insertion passage extends from the outer portion of said cutter means and intersects said locking groove means of said rotary cutter means in tangential manner; and (b) said lock means is inserted through said lock insertion passage means and received within said locking groove means of said cutter means and bushing means, said lock means securing said segment bushing means and cutter means in locked assembly.

7. A rotary earth boring drill bit as recited in claim 6, wherein:

(a) said locking groove means of said bushing means and cutter means are each of semi-circular cross-sectional configuration and cooperate in assembly to define a circular locking receptacle of circular cross-sectional configuration;

and (b) said lock means is a flexible elongated metal element having a circular cross-sectional configuration.

8. A rotary earth boring drill bit as recited in claim 1, wherein:

(a) said cutter means defines an internal tapered surface of larger dimension at the extremity thereof remote from said depending leg;

(b) said bushing means defining an external tapered surface mating with said tapered surface of said cutter means;

and (c) said tapered surfaces of said cutter means and bushing having an interference fit locking the same in assembly.

9. A rotary earth boring drill bit, comprising:

(a) a body structure adapted for threaded connection to a string of drill stem, said body structure defining depending cutter supporting leg means;

(b) spindle means formed integrally with said leg means and defining cylindrical bearing surface means, said spindle means and leg means defining a spindle connection bore;

(c) bushing means being disposed for rotation about said bearing surface means;

(d) bushing retainer means having a portion thereof extending through said spindle connection bore and being secured to said depending leg means, said bushing retainer means having an enlarged head portion defining a bearing thrust shoulder positioned in thrust force transmitting relation with said bushing means, said bushing retainer means defining a cylindrical surface having coextensive relation with said bearing surface of said integral spindle means, said bushing means forming an internal generally cylindrical bearing surface having rotatable bearing engagement with said cylindrical surface of said bushing retainer means and said bearing surface of said integral spindle means;

(e) rotary cutter means defining external cutter teeth and defining an internal spindle receptacle; and (f) means locking said cutter means in assembly with said bushing means whereby said cutter means and bushing means rotate about said bearing surface means.

10. A rotary earth boring drill bit as recited in claim 9, wherein:

(a) said bushing means defines an outer tapered surface of greater dimension at the outer extremity than at the inner extremity thereof; and (b) said cutter means defines a tapered internal surface forming a part of said internal spindle receptacle and being of larger dimension at the inner extremity than at the outer extremity thereof, said outer extremity of said bushing being received at the inner extremity of said internal spindle receptacle, said bushing means and said cutter means having an interference fit securing the same in assembly.

11. A rotary earth boring drill bit as recited in claim 10, wherein:

(a) said locking groove means of said bushing means and cutter means are each of semi-circular cross-sectional configuration and cooperate in assembly to define a circular locking receptacle of circular cross-sectional configuration;

and (b) said lock means being elongated metal means having a circular cross-sectional configuration.

12. A rotary earth boring drill bit as recited in claim 11, wherein:

said cutter means is formed to define a lock insertion passage extending from the outer portion of said cutter means to said locking groove and intersecting said cutter means in tangential relation.

13. A rotary earth boring drill bit as recited in claim 9, wherein:

(a) said rotary cutter means is formed internally thereof to define circular locking groove means and a lock insertion passage extending from the outer portion of said cutter means and intersecting said locking groove means in tangential manner;

(b) said segment bushing means define external circular locking groove means registering with said locking groove means of said cutter means; and (c) lock means being inserted through said lock insertion passage means and being received within said locking groove means of said cutter means and bushing means, said lock means securing said segment bushing means and cutter means in locked assembly.

* * * * *